US007748053B1

(12) United States Patent
Hancock

(10) Patent No.: US 7,748,053 B1
(45) Date of Patent: Jul. 6, 2010

(54) BULLET-RESISTANT BACK EXTENDER

(75) Inventor: William Hancock, Seale, AL (US)

(73) Assignee: Point Blank Body Armor, Pompano Beach, FL (US)

( * ) Notice: Subject to any disclaimer, the term of this patent is extended or adjusted under 35 U.S.C. 154(b) by 0 days.

(21) Appl. No.: 11/345,986

(22) Filed: Feb. 2, 2006

(51) Int. Cl.
*A41D 27/12* (2006.01)
*A41D 27/20* (2006.01)
*F41H 1/02* (2006.01)

(52) U.S. Cl. ..... 2/2.5; 2/102; 2/312; 2/247; 2/249; 2/338

(58) Field of Classification Search ..... 2/2.5, 2/464, 466, 467, 92, 102, 304, 307, 310, 2/311, 312, 319, 322, 338, 914, 913, 265, 2/251, 263
See application file for complete search history.

(56) References Cited

U.S. PATENT DOCUMENTS 2,076,076 A * 4/1937 Dunlap ..... 428/181
3,061,839 A * 11/1962 Foster ..... 2/2.5
3,696,439 A * 10/1972 Durham ..... 2/2.5
4,412,495 A * 11/1983 Sankar ..... 109/49.5
4,467,476 A * 8/1984 Herbert ..... 2/2.5
4,497,069 A * 2/1985 Braunhut ..... 2/2.5
4,660,223 A * 4/1987 Fritch ..... 2/2.5
4,783,853 A * 11/1988 Zuber ..... 2/456
4,870,706 A * 10/1989 Ketcham et al. ..... 2/461
4,884,295 A * 12/1989 Cox ..... 2/467
5,060,314 A * 10/1991 Lewis ..... 2/2.5
5,072,453 A * 12/1991 Widder ..... 2/2.5
5,123,120 A * 6/1992 Ross ..... 2/229
5,327,811 A * 7/1994 Price et al. ..... 89/36.05
5,398,340 A * 3/1995 Kibbee ..... 2/2.5
5,465,424 A * 11/1995 Cudney et al. ..... 2/462
5,495,620 A * 3/1996 Schoenweiss et al. ..... 2/2.5
5,495,621 A * 3/1996 Kibbee ..... 2/2.5
5,754,982 A * 5/1998 Gainer ..... 2/2.5
5,797,140 A * 8/1998 Davis et al. ..... 2/2.5
5,829,653 A * 11/1998 Kaiser ..... 224/577
5,974,585 A * 11/1999 Bachner, Jr. ..... 2/2.5
5,991,925 A * 11/1999 Wu ..... 2/102
6,098,196 A * 8/2000 Logan ..... 2/2.5
6,175,958 B1 * 1/2001 Wu ..... 2/2.5
6,182,288 B1 * 2/2001 Kibbee ..... 2/2.5
6,233,737 B1 * 5/2001 Ditchfield et al. ..... 2/2.5
6,266,818 B1 * 7/2001 Howland et al. ..... 2/2.5
6,408,440 B1 * 6/2002 Phillips ..... 2/102
6,543,055 B2 * 4/2003 Howland et al. ..... 2/2.5
6,681,400 B1 * 1/2004 Mills ..... 2/2.5
6,698,024 B2 * 3/2004 Graves et al. ..... 2/2.5
6,704,934 B2 * 3/2004 Graham et al. ..... 2/2.5
6,760,922 B1 * 7/2004 Morales ..... 2/94
6,769,137 B2 * 8/2004 D'Annunzio ..... 2/102
6,807,891 B2 * 10/2004 Fisher ..... 89/36.02
6,892,392 B2 * 5/2005 Crye et al. ..... 2/2.5
6,941,585 B2 * 9/2005 Wells, Jr. ..... 2/338

(Continued)

*Primary Examiner*—Bobby H Muromoto, Jr.
(74) *Attorney, Agent, or Firm*—Seth H. Ostrow; Ostrow Kaufman & Frankl LLP

(57) ABSTRACT

A bullet-resistant back extender includes an armor carrier having an inner pocket with a bullet-resistant ballistic panel disposed within the inner pocket and an upper portion of the armor carrier having a fastener to attach the bullet-resistant back extender to a fastener in a bullet-resistant vest.

11 Claims, 4 Drawing Sheets

U.S. PATENT DOCUMENTS 6,961,957 B2 * 11/2005 Carlson ..... 2/2.5
7,076,806 B1 * 7/2006 Van Winkle et al. ..... 2/2.5
2001/0029621 A1 * 10/2001 Howland et al. ..... 2/2.5
2003/0066116 A1 * 4/2003 Graves et al. ..... 2/2.5
2004/0083525 A1 * 5/2004 Wells, Jr. ..... 2/2.5
2005/0005342 A1 * 1/2005 Johnson ..... 2/102
2005/0005343 A1 * 1/2005 Johnson ..... 2/102
2005/0010987 A1 * 1/2005 Crye et al. ..... 2/2.5
2007/0079415 A1 * 4/2007 Carlson ..... 2/2.5

* cited by examiner

BULLET-RESISTANT BACK EXTENDER

FIELD OF INVENTION

The present invention relates to bullet-resistant armor, and more specifically to a bullet-resistant back extender.

BACKGROUND

Conventional bullet-resistant vests do not provide coverage for the lower back or buttocks area, where coverage is necessary or critical in certain situations. Vest coverage generally does not go lower than the beltline of the user. The rigidity of ballistic material may limit the mobility of the user if the vest included a longer back portion that covered the user below the beltline, which could cause the user injury if he was unable to move freely.

SUMMARY

The present invention provides an extender for a bullet-resistant vest to protect the lower back and buttocks of a user.

In general, in one aspect, the invention features a bullet-resistant back extender including an armor carrier having an inner surface, an outer surface and an inner pocket created between the inner surface and the outer surface, a bullet-resistant ballistic panel disposed within the inner pocket of the armor carrier, an upper portion of the armor carrier having an inner surface and an outer surface and a fastener on the upper portion to attach the bullet-resistant back extender to a fastener in a bullet-resistant vest.

In embodiments, the fastener on the upper portion of the armor carrier is located on the inner surface of the upper portion and the fastener on the bullet-resistant vest is attached to a flap on a back, inner surface of the bullet-resistant vest. In another embodiment, the fastener on the upper portion of the armor carrier is located on the outer surface of the upper portion and the fastener on the bullet-resistant vest is attached to a back, inner surface of the bullet-resistant vest. In embodiments, the fastener on the upper portion of the armor carrier and the fastener on the bullet-resistant vest may be hook and loop fasteners, zippers or snaps.

In other embodiments, the bullet-resistant back extender also includes attachment straps affixed to the outer surface of the armor carrier and can be used to further secure the bullet-resistant back extender to webbing on the bullet-resistant vest. In certain embodiments, the attachment straps may have fasteners that connect to each other. In embodiments, the fastener on the attachment straps may be hook and loop fasteners, zippers, snaps or buckles.

In embodiments, the bullet-resistant vest also has a lower portion that extends beyond the flap and onto the outer surface of the armor carrier. In certain embodiments, the lower portion is attached to the outer surface of the armor carrier by fasteners. In embodiments, the fasteners may be hook and loop fasteners, zippers or snaps.

In other embodiments, the armor carrier may also have a sealable opening to allow access to the inner pocket. In still other embodiments, the armor carrier may also have pockets on the outer surface.

In general, in another aspect, the invention features a bullet-resistant back extender including an armor carrier having an inner surface, an outer surface and an inner pocket created between the inner surface and the outer surface, a bullet-resistant ballistic panel disposed within the inner pocket of the armor carrier, an upper portion of the armor carrier having an inner surface and an outer surface with a fastener on the inner surface of the upper portion to attach the bullet-resistant back extender to a fastener on a flap on an inner surface of a bullet-resistant vest, and at least one attachment strap on the outer surface of the armor carrier to secure the bullet-resistant back extender to webbing on an outer surface of the bullet-resistant vest.

In general, in yet another aspect, the invention features a bullet-resistant armor system including a bullet-resistant vest having a front portion and a back portion, the back portion having an inner and an outer surface, a flap attached to the inner surface of the back portion, a first fastener attached to the flap and facing the inner surface of the back portion, and webbing attached to the outer surface of the back portion to create loops on the outer surface of the back portion and bullet-resistant back extender including an armor carrier has an inner surface, an outer surface and an inner pocket created between the inner surface and the outer surface, a bullet-resistant ballistic panel is disposed within the inner pocket of the armor carrier, an upper portion of the armor carrier has an inner surface and an outer surface, a second fastener on the inner surface of the upper portion, and at least one attachment strap on the outer surface of the armor carrier and having third and fourth fasteners disposed on the attachment strap. The bullet-resistant back extender is attached to the bullet-resistant vest such that the second fastener on the inner surface of the upper portion of the armor carrier attaches to the first fastener attached to the flap facing the inner surface of the back portion of the vest and the attachment strap on the armor carrier pass through the loop created by the webbing and attaches back onto itself by the third and forth fasteners.

The invention can be implemented to realize one or more of the following advantages. First, the bullet-resistant back extender can be made to fit several different vests, including vests presently owned by a user, thereby providing an economical benefit to the various agencies who utilize bullet-resistant garments. Further, the bullet-resistant back extender can be made to different lengths, offering different amounts of protection depending on the situation in which it will be used or to fit different body types of those that use bullet-resistant garments. Still further, the detachable connection enables more flexibility between the bullet-resistant vest and back extender, thereby providing better mobility for the user when worn. Also, having the bullet-resistant back extender removable enables more options in configuring a bullet-resistant system. Still further, allowing the bullet-resistant back extender to be removable enables easier access by medical or emergency personnel should the user be injured, potentially enabling the bullet-resistant system worn by the user to be removed piece-by-piece to limit the amount of movement of the injured user.

Other features and advantages of the invention are apparent from the following description, and from the claims.

BRIEF DESCRIPTION OF THE DRAWINGS

Like reference numbers and designations in the various drawings indicate like elements.

DETAILED DESCRIPTION

Figure 1:
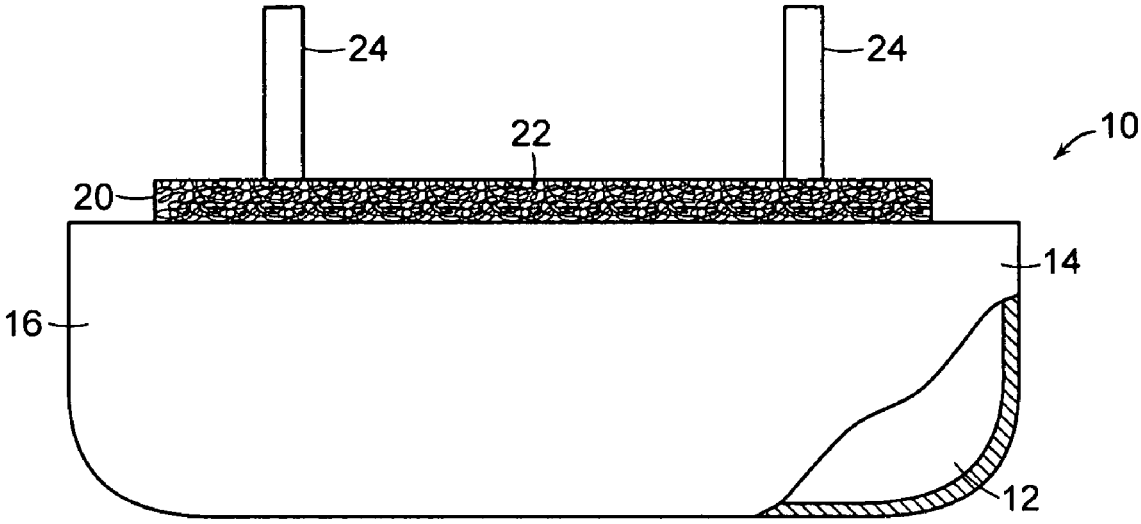
FIG. 1 is a partial cut-away view of an inner surface of an exemplary bullet-resistant back extender according to one embodiment of the invention.
Figure 2:
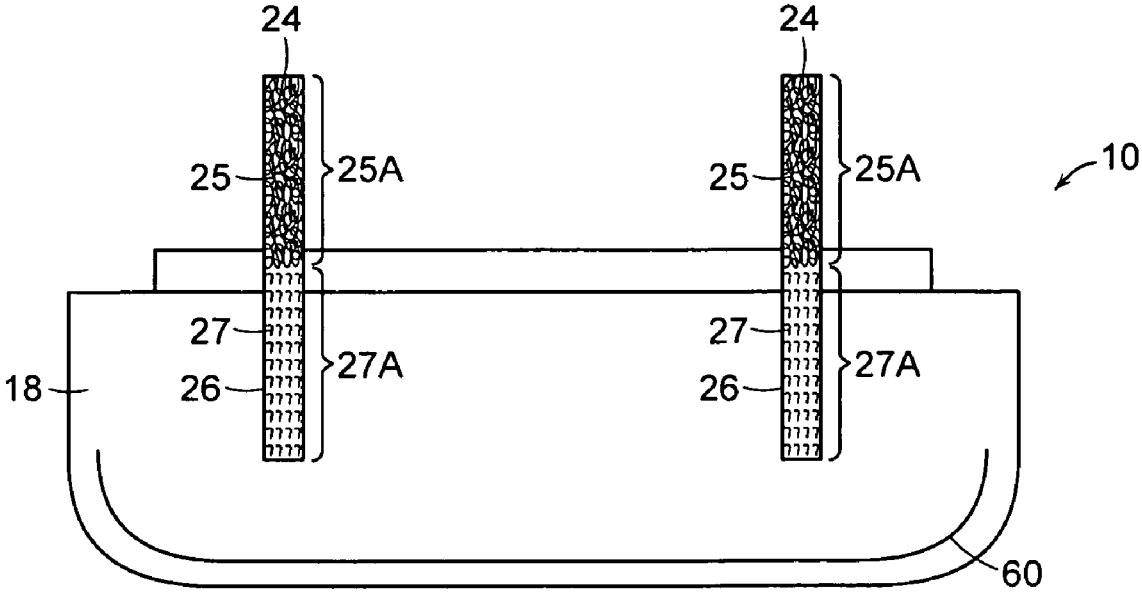
FIG. 2 is a view of an outer surface of the bullet-resistant back extender of FIG. 1.

Referring to FIGS. 1 and 2, a bullet-resistant back extender 10 includes a bullet-resistant ballistic panel 12 within an armor carrier 14. The bullet-resistant back extender 10 has an inner surface 16 and an outer surface 18. The inner surface 16 faces a user when worn. The armor carrier 14 includes an upper portion 20 having one half of a removable fastener 22 on its inner surface. The fastener 22 can be a hook and loop system (e.g., Velcro®) as shown. However, any separable fastener such as a zipper, snaps or any other two piece fastening system can be used.

The armor carrier 14 also includes attachment straps 24 with an affixed portion 26 fastened to the outer surface 18. The attachment straps 24 may bond to themselves through removable fasteners, one half of the removable fastener 25 within area 25A and the other half of the removable fastener 27 within area 27A. The fasteners 25 and 27 can be a hook and loop system (e.g., Velcro®) as shown. However, any separable fastener such as a zipper, snaps or any other fastening system can be used. Use of the attachment straps is explained more fully below.

Figure 3:
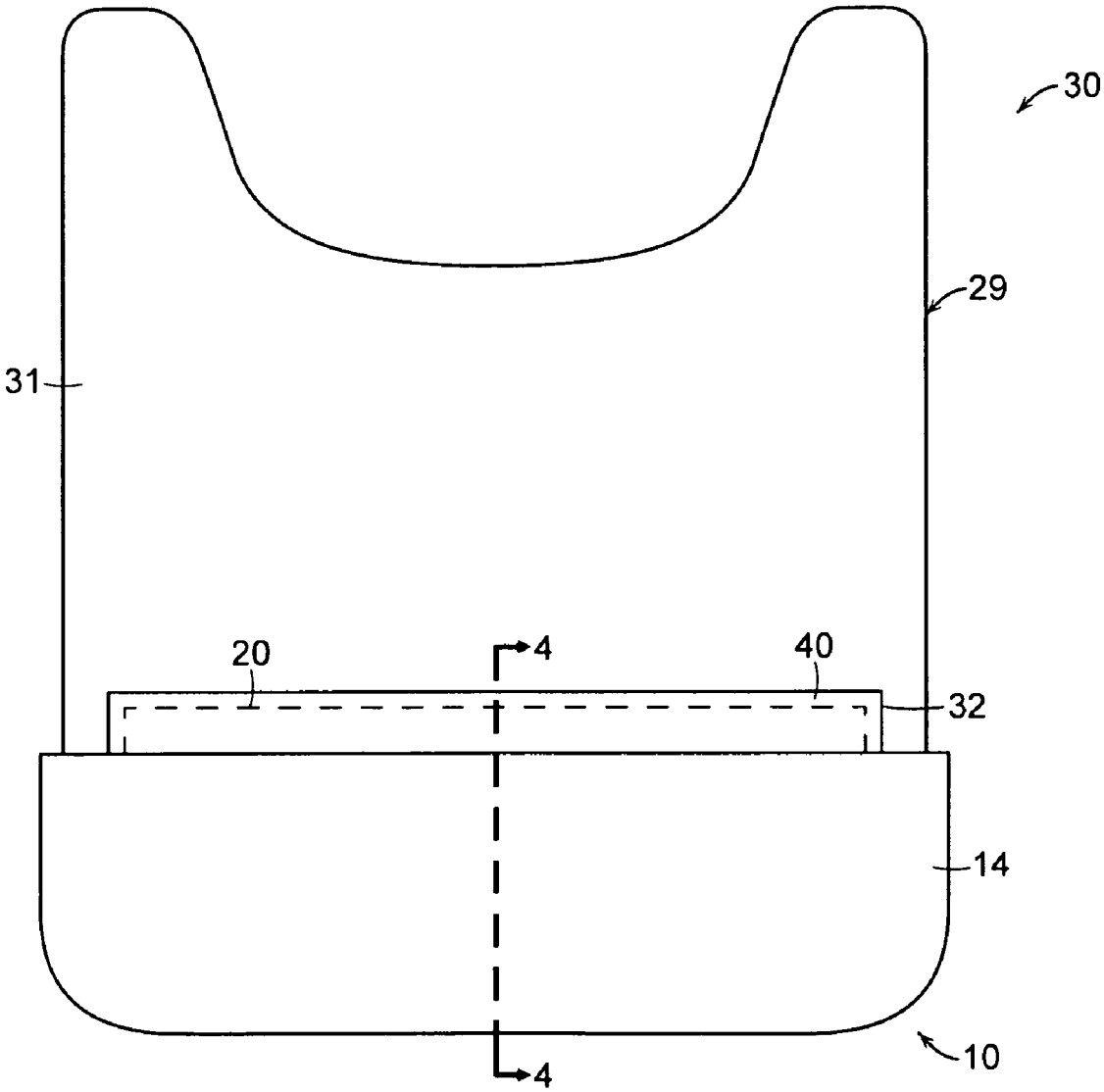
FIG. 3 is a view of the inner surface of the bullet-resistant back extender of FIG. 1 attached to a back, inner surface of a bullet-resistant vest.
Figure 4:
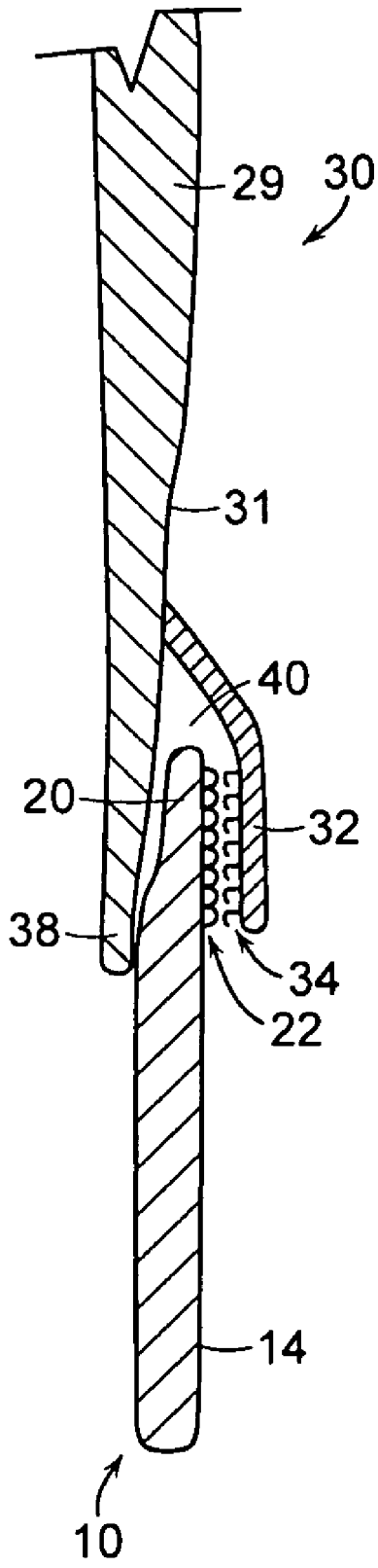
FIG. 4 is a cut-away side view of the bullet-resistant back extender attached to the bullet-resistant vest shown in FIG. 3 taken along line 4-4.

Referring now to FIGS. 3 and 4, the bullet-resistant back extender 10 is attached to a back portion 29 of a bullet-resistant vest 30. The bullet-resistant vest 30 has a back portion 29 which is adjacent to a user's back and a front portion (not shown) which is adjacent to a user's chest and abdomen. The back portion 29 includes an inner surface 31 and an outer surface 33. The bullet-resistant back extender 10 is attached to the back portion 29 of a bullet-resistant vest 30 by inserting upper portion 20 into a pocket 40 formed by flap 32 on the inner surface 31 of the back portion 29 of the vest 30. Flap 32 includes a second half of a removable fastener 34 that mates with removable fastener 22 on the upper portion 20 of the bullet-resistant back extender 10. To attach the bullet-resistant back extender 10 to the vest 30, the upper portion 20 of bullet-resistant back extender 10 is inserted into pocket 40 and fastener 22 is mated to fastener 34, thereby removably attaching the bullet-resistant back extender 10 to vest 30. The attachment area of the bullet-resistant back extender 10 to the vest 30 is protected by a lower portion 38 of the vest 30 which extends past the pocket 40 and over the outer surface 18 of the bullet-resistant back extender 10. Allowing the lower portion 38 of the vest 30 to extend past the pocket 40 helps reduce intrusion of foreign matter, such as dirt, sand or water, into the pocket, which could potentially damage the removable fasteners 22 and 34. Also, the lower portion 38 of the vest can also be removably attached to the outer surface 18 of the back extender by fasteners, such as hook and loop (e.g., Velcro®), zippers, snaps or any other fastening system.

Figure 5:
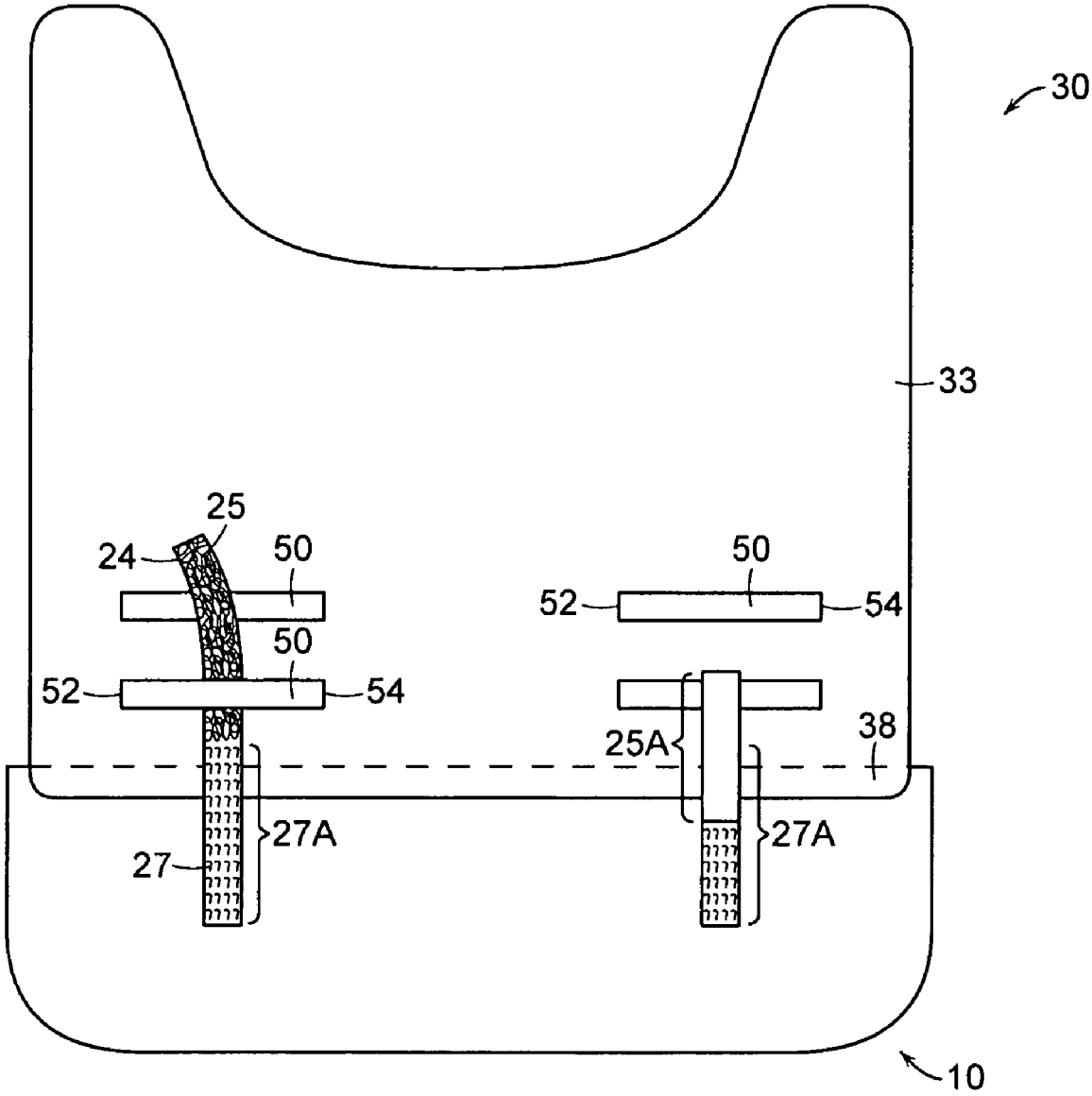
FIG. 5 is a view of a back, outer surface of the bullet-resistant back extender attached to the bullet-resistant vest shown in FIG. 3.

Referring to FIG. 5, the bullet-resistant back extender 10 is further attached to vest 30 by attachment straps 24. Vest 30 includes webbing 50 attached to a the outer surface 33 of the back portion 29 of the vest 30. The webbing 50 is attached at each end 52 and 54 thereby providing a loop through which the attachment straps 24 can pass. To fasten attachment straps 24 to the vest 30, one attachment strap 24 is guided under and through a webbing 50. The attachment strap 24 is then folded back onto itself and secured by fasteners 25 and 27, thereby further securing the bullet-resistant back extender 10 to the vest 30.

The ballistic panel 12 may be made to provide the required degree of protection for the situation. For example, for a 124 grain 9 mm full metal jacket projectile, the ballistic panel 12 may provide protection of V50 at 0° of 1525 ft/sec, more preferably 1625 ft/sec or higher. However, less protection may be provided if the situation warrants. The ballistic panel 12 may be made of any known bullet-resistant material, such as para-aramid (e.g., Kevlar®), polypropylene, PBO or any other bullet-resistant material or combination thereof. The armor carrier 14 may be made of any appropriate fabric, such as nylon, polyester or cotton.

It is to be understood that the foregoing description is intended to illustrate and not to limit the scope of the invention, which is defined by the scope of the appended claims. Other embodiments are within the scope of the following claims. For example, armor carrier 14 can include a sealable opening 60 (FIG. 2) that enables the ballistic panel 12 to be removed from the armor carrier 14 to allow for other ballistic panels to be inserted or to allow for the armor carrier 14 to be washed. The opening 60 may also allow the insertion of a trauma plate into the back extender 10, thereby providing additional protection from ballistic threats and other threats such as shrapnel and non-ballistic threats (e.g., knives). The opening 60 can be sealed with a hook and loop fastener, a zipper, snaps or any other fastener that seals the opening and prevents the ballistic panel 12 from falling out during use.

Also, the armor carrier 14 may include outer pockets in which to carry additional items, such as extra clips of ammunition, knives, food or any other item the user may need.

Further, the bullet-resistant back extender 10 can include one or more attachment straps 24. Also, the attachment straps can be attached to themselves with buckles instead of two-piece fasteners. Further still, the webbing 50 can be attached at one end 52 to the back of the vest 30 and the other end 54 to the front of the vest (i.e., towards the front of the user). The webbing can also be adjustable in length, which, if attached to the front and the back of the vest, can allow the webbing to also act as a method of fitting the vest to the user.

Still further, while described as being attached to a specific bullet-resistant vest (e.g., one specifically designed to accept a bullet-resistant back extender), any bullet-resistant vest can be modified to accept the bullet-resistant back extender by applying the appropriate fastener to the vest. Also, many bullet-resistant vests already include webbing 50 to which the bullet-resistant back extender can be attached through the attachment straps 24. Further still, a user need not use both the fastener 22 on the upper portion 20 of the bullet-resistant back extender and the attachment straps 24, but rather can use one or the other exclusively.

Also, the fastener 22 on the back extender can be on an outer surface of the upper portion 20. In this configuration, the fastener 34 on the bullet-resistant vest can be applied directly to the back, inner surface of the vest without the need for a flap 32 and the back extender 10 can thus be attached through the fasteners 22 and 34.

What is claimed is:

1. A bullet-resistant back extender for use on a bullet-resistant vest, the bullet-resistant back extender comprising:

an armor carrier including an inner surface and an outer surface configured to form an inner armor carrier pocket positioned between the inner surface and the outer surface;

a bullet-resistant ballistic panel disposed within the inner pocket of the armor carrier; and a first fastener positioned proximate an upper portion of the armor carrier, wherein the first fastener is configured to releasably engage a complimentary second fastener within a retention pocket formed between an inner surface of the bullet-resistant vest and a flap flexibly attached to the inner surface of the bullet-resistant vest.

2. The bullet-resistant back extender of claim 1 wherein the first fastener and the complimentary second fastener are chosen from the group consisting of hook and loop fasteners, zippers or snaps.

3. The bullet-resistant back extender of claim 1 further comprising attachment straps affixed to the outer surface of the armor carrier, wherein the attachment straps are configured to further secure the bullet-resistant back extender to webbing attached to an outer surface of the bullet-resistant vest.

4. The bullet-resistant back extender of claim 3 further comprising fasteners on the attachment straps configured to connect to each other.

5. The bullet-resistant back extender of claim 4 wherein the fastener on the attachment straps are chosen from the group consisting of hook and loop fasteners, zippers, snaps or buckles.

6. The bullet-resistant back extender of claim 1 wherein the bullet-resistant vest further comprises a lower portion that extends beyond the flap and onto the outer surface of the armor carrier.

7. The bullet-resistant back extender of claim 6 wherein the lower portion is attached to the outer surface of the armor carrier by fasteners.

8. The bullet-resistant extender of claim 7 wherein the fasteners are chosen from the group consisting of hook and loop fasteners, zippers or snaps.

9. The bullet-resistant back extender of claim 1 wherein the armor carrier further comprises a sealable opening to allow access to the inner armor carrier pocket.

10. The bullet-resistant back extender of claim 1 wherein the armor carrier further comprises pockets on the outer surface.

11. A bullet-resistant back extender for use on a bullet-resistant vest, the bullet-resistant back extender comprising:

an armor carrier including an inner and an outer surface configured to form an inner armor carrier pocket positioned between the inner surface and the outer surface;

a bullet-resistant ballistic panel disposed within the inner armor carrier pocket;

a first fastener positioned proximate an upper portion of the armor carrier, wherein the first fastener is configured to releasably engage a complimentary second fastener attached to a flap flexibly attached to an inner surface of the bullet-resistant vest; and at least one attachment strap affixed to the outer surface of the armor carrier, the attachment strap configured to secure the bullet-resistant back extender to webbing attached to an outer surface of the bullet-resistant vest.

* * * * *